US007070426B2

(12) United States Patent
DeCell, Jr. et al.

(10) Patent No.: US 7,070,426 B2
(45) Date of Patent: Jul. 4, 2006

(54) ELECTRIC OUTLET CHILD SAFETY CAP

(76) Inventors: George Raymond DeCell, Jr., 334 Sam Webb Rd., Fairfax, VT (US) 05454; Estelle Rita DeCell, 334 Sam Webb Rd., Fairfax, VT (US) 05454

( * ) Notice: Subject to any disclaimer, the term of this patent is extended or adjusted under 35 U.S.C. 154(b) by 0 days.

(21) Appl. No.: 10/850,748

(22) Filed: May 22, 2004

(65) Prior Publication Data

US 2005/0020112 A1 Jan. 27, 2005

Related U.S. Application Data

(60) Provisional application No. 60/477,115, filed on Jun. 9, 2003.

(51) Int. Cl.
*H01R 13/44* (2006.01)

(52) U.S. Cl. ..... 439/135; 439/148

(58) Field of Classification Search ..... 439/135, 439/148, 149; 174/66, 67
See application file for complete search history.

(56) References Cited

U.S. PATENT DOCUMENTS 2,629,761 A * 2/1953 Determan ..... 439/148
3,656,083 A * 4/1972 Brook ..... 439/147
5,106,314 A * 4/1992 Bael ..... 439/148
5,989,052 A * 11/1999 Fields et al. ..... 439/373
6,036,536 A * 3/2000 Chiu ..... 439/536
6,674,003 B1 * 1/2004 Torres ..... 174/66

OTHER PUBLICATIONS www.perfectlysafe.com/perfectlysafe/cords.*
www.babyuniverse.com/cat/baby/107/electrical.*
Consumer Reports Magazine, Nov. 2005, p. 8, "Two Childproof Devices Not Acceptable".*

* cited by examiner

*Primary Examiner*—Michael C. Zarroli
(74) *Attorney, Agent, or Firm*—James Marc Leas

(57) ABSTRACT

An electric outlet child safety cap is provided. Designs include one or more openings in the shield of the safety cap to allow air to pass there through to reduce or to substantially eliminate a choking hazard with the electric outlet safety caps. Safety caps having shields with at least one dimension that is larger than about 1⅔ inches are also provided to reduce or eliminate the chance that a small child will be able to insert the safety cap in the mouth and choke. The openings can be combined with the larger than standard sized shields for additional resistance to the choking hazard.

64 Claims, 8 Drawing Sheets

ELECTRIC OUTLET CHILD SAFETY CAP

This application claims priority of U.S. Provisional Patent Application 60/477,115, "Anti-choking electrical cap/plug," filed Jun. 9, 2003.

FIELD OF THE INVENTION

This invention generally relates to a child safety caps for electrical outlets. More particularly, it relates to a cap for an electrical outlet that provides greater safety for small children.

BACKGROUND AND SUMMARY OF THE INVENTION

Safety caps for electrical outlets have been used to reduce the hazard to small children from shocks and electrocution. However, the present inventor recognized that these safety caps introduce their own hazard to small children from choking. The hazard may arise when a small child finds a safety cap on the floor or on a window sill. The hazard can also arise when the child pulls the safety cap from a wall outlet or when an older sister or brother removes a safety cap from a wall outlet and gives the cap to the smaller child. Data from the United States Consumer Product Safety Commission (USCPSC) demonstrates numerous reported incidents in which infants and toddlers pulled electric outlet safety caps from outlets and put them in their mouths. The USCPSC listing provides a hazard code: "suffocation or strangulation."

Thus, a better design for an electrical outlet safety cap is needed that maintains safety from electrical shock while improving safety with regard to choking. The improved design is provided by the present invention.

It is therefore an object of the present invention to provide an electrical outlet safety cap that has a safety cap shield to cover the electrical outlet and at least one opening in the safety cap shield located and sized so that a child can breath through the opening in the cap shield if the child puts the safety cap in his or her mouth;

It is a further object of the present invention to provide the opening in the safety cap shield sufficiently spaced from the position of the electrical contact hole so that objects a child may stick through the opening in the safety cap shield when the safety cap is located to protect a wall outlet do not enter the electrical contact hole of the wall outlet;

It is a further object of the present invention to provide the opening in the electrical outlet safety cap shield with a sufficient size so that sufficient air can be drawn through the opening for breathing in the event a child does take the safety cap in his or her mouth and so that medical personal can use the opening to facilitate removing the cap from a child's throat or other oriface;

It is a further object of the present invention to provide an electrical outlet safety cap for an electric outlet comprising a safety cap shield extending to cover the electrical contact hole, wherein the shield has a dimension larger than standard sized shields and sufficiently large to reduce the opportunity for a small child to take the safety cap in his or her mouth and choke on the safety cap;

It is a feature of the present invention to provide the electrical outlet safety cap for an electric outlet wherein the safety cap shield has a dimension of at least about 1⅔ inches;

It is a feature of the present invention that the electrical outlet cap has an opening to allow a small child to continue breathing through the opening if the child does get the cap in her mouth; and It is an advantage of the present invention that a small child will not be able to choke on the larger sized electrical outlet cap of the present invention;

It is an advantage of the present invention that if a small child does get the safety cap of the present invention in a position in her mouth where it could choke her, the opening in the cap will provide a way for her to still continue breathing and a way for medical personnel to grasp and remove the cap.

These and other objects, features, and advantages of the invention are accomplished by a safety cap for an electric outlet having an electrical contact hole. A shield portion of the safety cap extends to cover the electrical contact hole. The shield includes an opening. The opening in the shield has a sufficient size for reducing a choking hazard.

Another aspect of the invention is a method of fabricating a safety cap for an electric outlet comprising the step of providing a safety cap having a shield. The method also includes the step of providing an opening in the shield. The opening is sized to allow sufficient air to flow there through to reduce a choking hazard for a small child.

Another aspect of the invention is a safety cap for an electric outlet. The electrical contact has an electrical contact hole. A shield portion of the safety cap extends to cover the electrical contact hole. The shield has a dimension large enough to avoid a choking hazard for small children.

BRIEF DESCRIPTION OF THE DRAWINGS

The foregoing and other objects, features, and advantages of the invention will be apparent from the following detailed description of the invention, as illustrated in the accompanying drawings, in which:

FIG. 2 is a three dimensional view of one embodiment of the electrical outlet safety cap of the present invention showing the shield portion of the safety cap with openings that allow air to pass there through;

DETAILED DESCRIPTION OF THE INVENTION

The present inventor recognized that while standard electrical outlet caps improve safety for small children with regard to electrical shock hazards they introduce choking hazards. He found several ways to reduce this choking hazard while fully maintaining protection from the electrical shock hazard.

Figure 1:
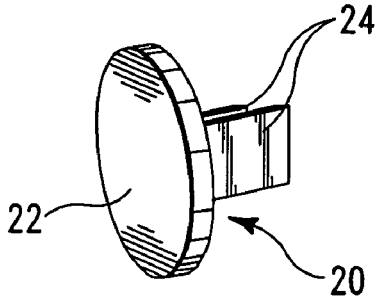
FIG. 1 Prior Art
FIG. 1*a* is a three dimensional view of a standard electrical outlet safety cap of the prior art for mounting on an electrical outlet showing the shield portion of the safety cap and the prongs that extend into holes of the electrical outlet.

Standard electrical safety cap 20 includes shield portion 22 and prongs 24, as shown in FIG. 1. Typically all portions of standard safety cap 20, including prongs 24 and shield 22, are fabricated of an electrically insulating material, such as plastic. Prongs 24 have a shape and dimensions and are spaced apart sufficiently to fit into two of the contact holes of an electrical outlet (not shown). Prongs 24 each have a dimension to be held tightly by the electrical contacts and to provide sufficient resistance to removal from the contact holes so as to restrict a small child from removing the safety cap. When safety cap 20 is fully inserted into the electrical outlet, shield portion 22 is designed to completely cover the contact holes of the electrical outlet. Thus, safety cap is fully inserted shield portion 22 prevents a child from inserting a finger or any other object into any of the contact holes of the electrical outlet.

However, the present inventor noticed another hazard introduced by the safety cap itself. He found that an older child can remove standard safety cap 20 and hand it to a smaller child. Or a small child can find standard safety cap 20 that may have been previously removed by an adult and inadvertently left on a window sill or on the floor. The present inventor noticed that the small child can then insert standard safety cap 20 into his or her own mouth and choke on the safety cap. The present inventor also recognized that the design of standard safety cap 20 could be improved in at least two ways to protect against the choking hazard.

One embodiment of the present invention is to improve resistance to the choking hazard by providing at least one opening 26 in shield 28 of electrical safety cap 30, as shown in FIGS. 2*a*, 3*a*–3*n*, and 5. Preferably two or more openings 26 are provided. Opening 26 preferably has a dimension of at least about 0.2 inches to allow sufficient air to flow through the safety cap if the safety cap is taken into the mouth. Preferably opening 26 has a dimension in the range from about 0.2 inches to about 0.3 inches. Various shapes, locations and numbers of opening 26 can be provided, as shown in FIGS. 3*a*–3*m*, including round, slotted, oval, rectangular, square, and triangular. One, two, three, four or more openings can be provided in shield 28. Preferably, opening 26 is spaced from edge 32 and spaced from the location of prongs 24. Spacing from edge 32 facilitates air flow that could be still be blocked by soft tissue of the throat if the opening is located at or near edge 32. Spacing from the location of prongs 24 avoids introducing a shock hazard from the ability to use the opening to access the electrical contact. Thus, in each FIG. 3*a*–3*m*, opening 26 is spaced from edge 32 and spaced from prongs 24.

Figure 4:
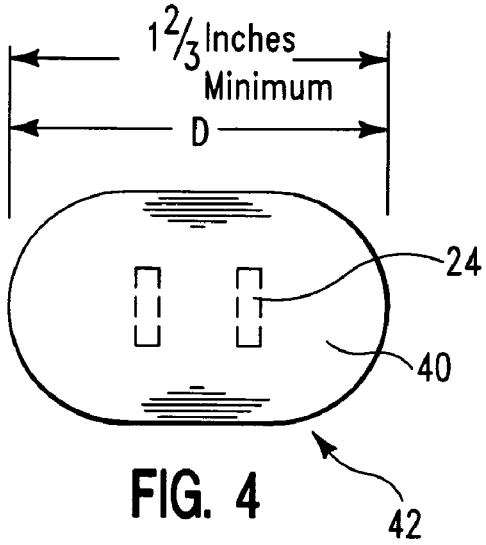
FIG. 4 is a front view of another embodiment of the electrical outlet safety cap of the present invention showing a shield portion having a dimension that is sufficiently large to reduce the chance of choking on the safety cap.

Another embodiment of the present invention improves resistance to the choking hazard by providing shield 40 of safety cap 42 with a substantially larger dimension D than standard electrical outlet safety caps have, as shown in FIG. 4. Thus shield 40 has a substantially larger dimension D than does shield 22 of standard safety cap 20. With larger dimension D, preferably greater than about 1⅔ inches, a small child will not be able to fit safety cap 42 in his or her mouth, at least not in a position in the mouth where he or she can choke. The shape of larger shield 40 can have a shape such as oblong, oval, round, square, or rectangular. It can be clear or have a color, such as white, off white, brown, black or any other color. Shield 40 can be flat or it can have another shape such as a bowl or pan shape.

Figure 5:
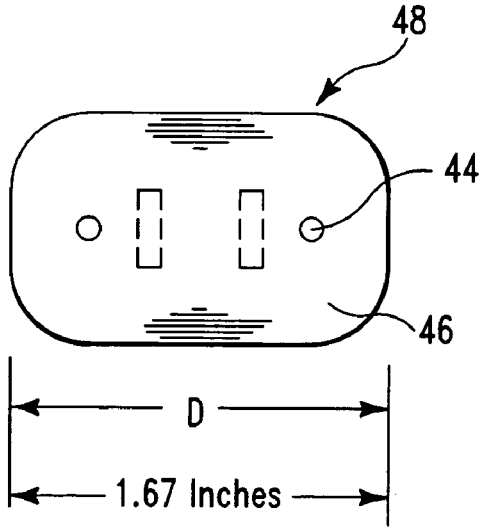
FIG. 5 is a front view of another embodiment of the electrical outlet safety cap of the present invention showing a shield portion that both has a dimension that is sufficiently large to reduce the chance of choking on the safety cap and openings in the shield portion that would allow for breathing and removal if the cap is ingested.
Figure 3A:
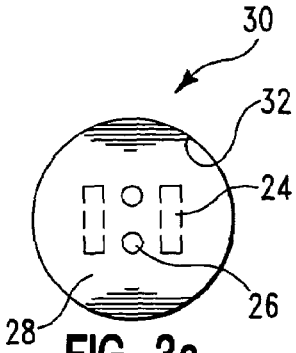
FIGS. 3*a*–3*n* are front views of electrical outlet safety cap of the present invention showing various possible locations and shapes for the opening in the shield portion of the safety cap.
Figure 3B:
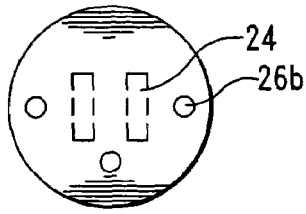
Figure 3C:
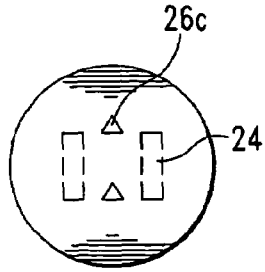
Figure 3D:
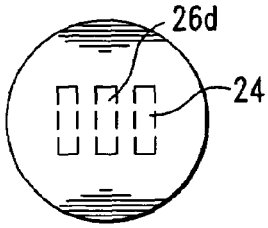
Figure 2:
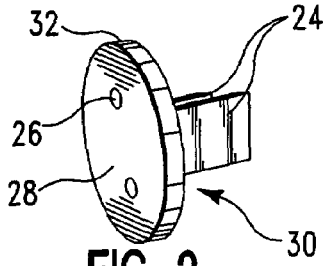
Figure 3E:
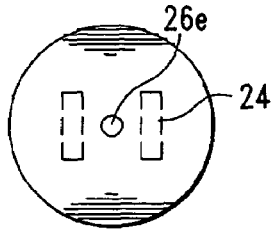
Figure 3F:
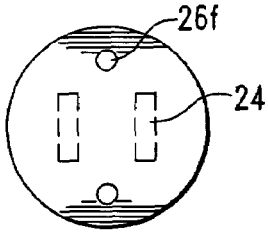
Figure 3G:
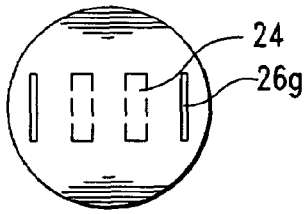
Figure 3H:
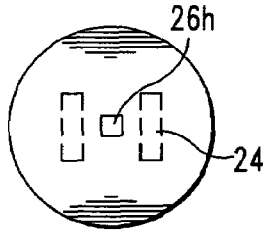
Figure 3I:
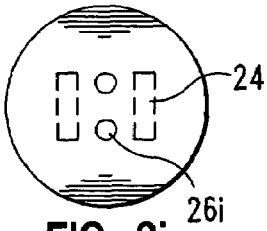
Figure 3J:
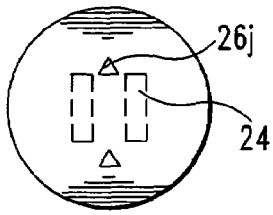
Figure 3K:
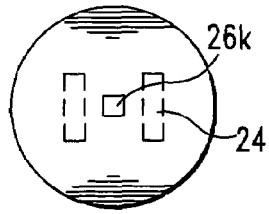
Figure 3L:
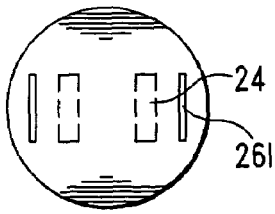
Figure 3M:
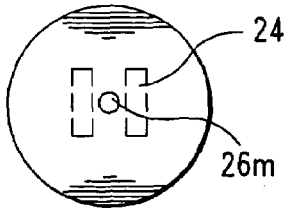
Figure 3N:
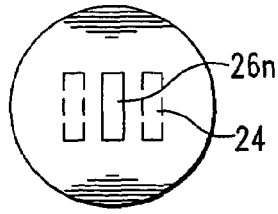

For additional safety from the choking hazard, at least one opening 44 can also be provided in larger shield 46 of safety cap 48, as shown in FIG. 5. Preferably at least two openings 44 are provided. Other configurations of at least one opening 44 can be used in the larger shield, similar to the shapes and locations of openings 26 shown in FIGS. 3*a*–3*m*.

Figure 6:
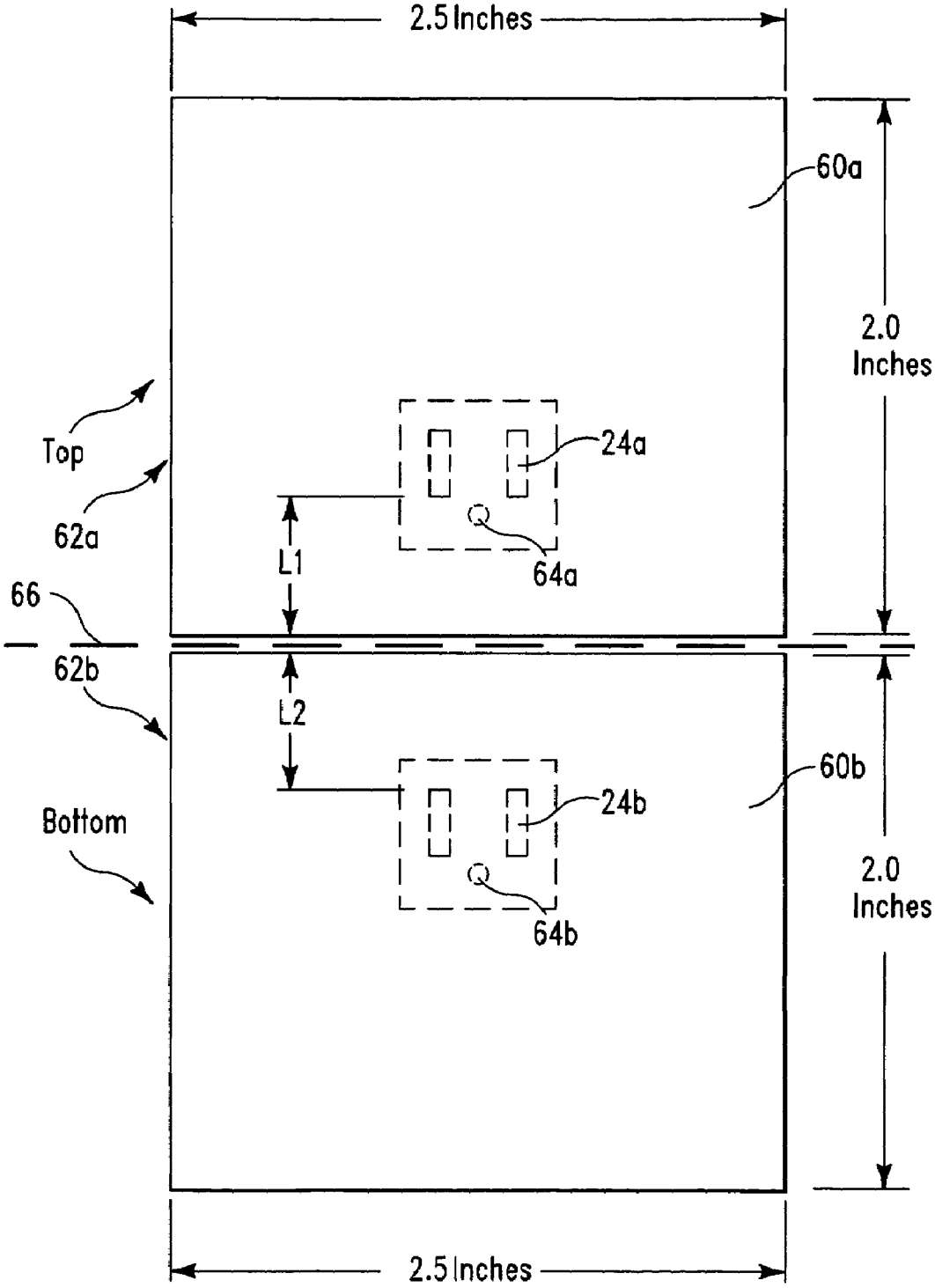
FIG. 6 is a front view of another embodiment of the electrical outlet safety cap of the present invention showing a shield portion having a two dimensions that are sufficiently large to reduce the chance of choking on the safety cap.

An alternative design for safety caps with larger shields 60*a*, 60*b*, each having dimensions D and H, is shown in FIG. 6. Dimensions D and H are sufficiently large to preclude a choking hazard for a small child while still approximately fitting the dimensions of a standard wall outlet cover (not shown). Two slightly different safety caps 62*a*, 62*b* are provided, 62*a* with prongs positioned for an upper position, and 62*b* with prongs positioned for a lower position. A different design is required for safety caps 62*a*, 62*b* because grounding contact prongs 64*a*, 64*b* are both oriented in the same direction for both safety caps 62*a*, 62*b*. Spacing L1 between centerline 66 and prongs 24*a* is about ¾ inch and spacing L2 between centerline 66 and prongs 24*b* is about ¼ inch, as shown in FIG. 6. Either safety cap 62*a* or 62*b* can be removed without removing the other safety cap for access to one of the two electrical outlets.

Figure 7A:
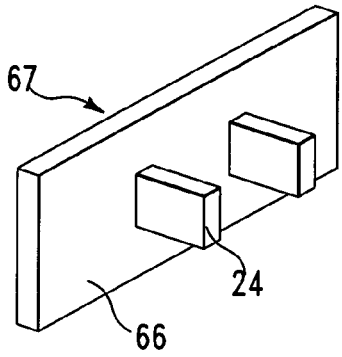
FIG. 7*a* is a three dimensional view of an embodiment of the electrical outlet safety cap of the present invention showing a shield portion having a dimension that is sufficiently large to reduce the chance of choking on the safety cap.
Figure 7B:
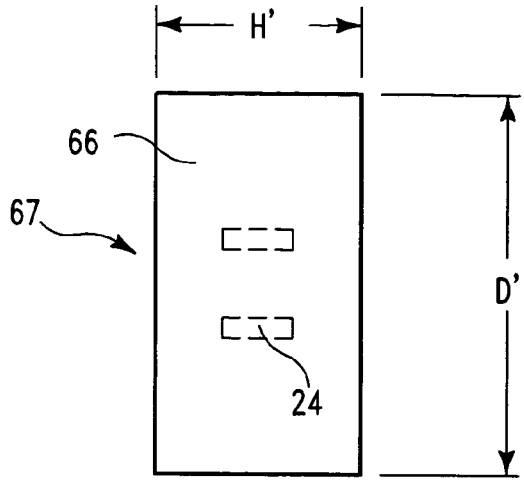
FIG. 7*b* is a front view of the shield shown in FIG. 7*a;*
Figure 8A:
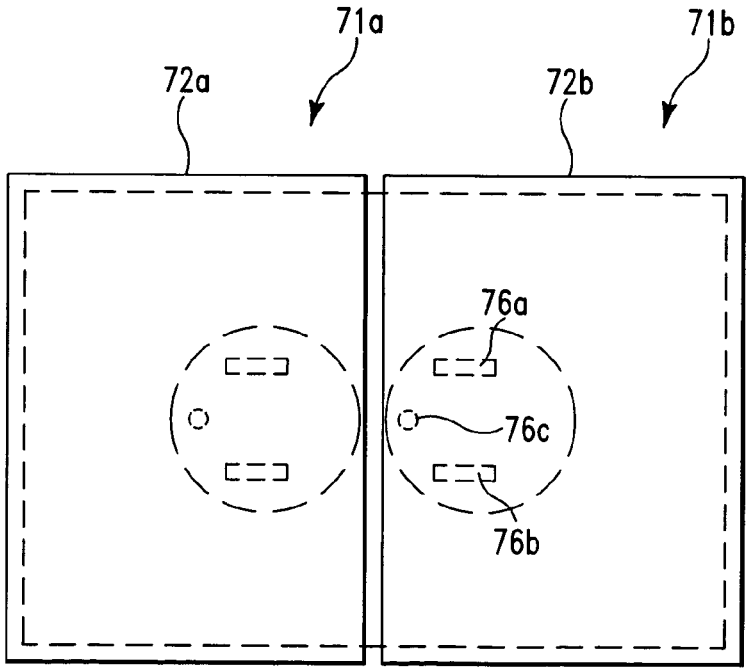
FIGS. 8*a*, 9*a*, 9*b*, are front views of three prong embodiments of the electrical outlet safety cap of the present invention showing shield portions that have at least one dimension that is sufficiently large to reduce the chance of choking on the safety cap.
Figure 8B:
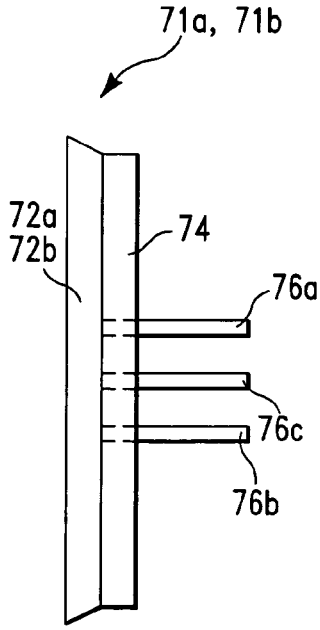
FIG. 8*b* is a side view of the embodiment shown in FIG. 8*a;*
Figure 9A:
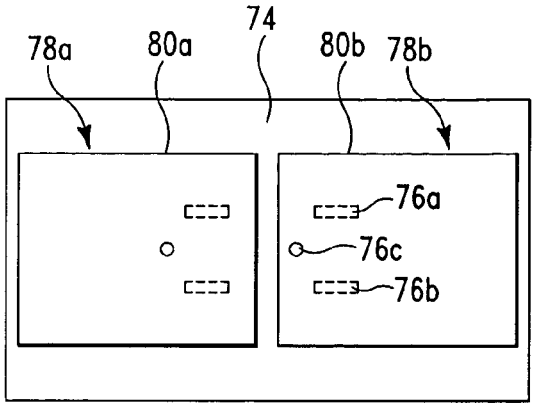
Figure 9B:
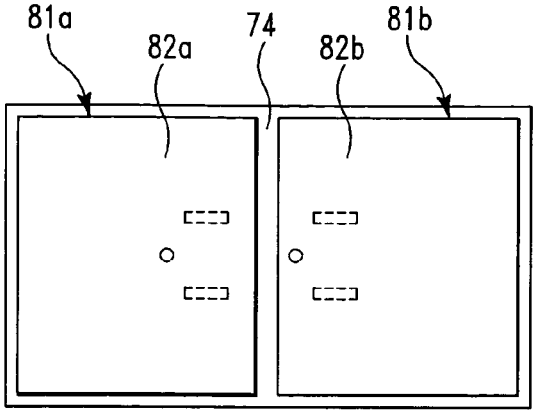

Other large-shield designs are shown in FIGS. 7*a*–7*b*, 8*a*–8*b*, 10*a*–10*b*, 11*a*–11*b*, 12*a*–12*b*, 13*a*–13*c*, 14*a*, 14*c*, and 15*a*–15*d*. Comparison with standard sized shields of the prior art are given in FIGS. 13*d*, 14*b*, and 14*d*. Rectangular shield 66 of safety cap 67 fabricated by the present inventor is shown in FIGS. 7*a*–7*b* wherein at least one of the dimensions D', H' is sufficient to reduce the choking hazard. A pair of safety caps 71*a*, 71*b* with larger shields 72*a*, 72*b* are shown in FIG. 8*a*–8*b*. In this embodiment the pair of safety caps 71*a*, 71*b* have dimensions approximately matching or extending beyond the dimensions of standard wall outlet cover 74. Safety caps 78*a*, 78*b*, 81*a*, 81*b* need not extend beyond the dimensions of wall outlet 74, as shown in FIGS. 9*a*–9*b*, in which one or more dimensions of shield 80*a*, 80*b*, 82*a*, 82*b* are smaller than the corresponding dimension of standard wall outlet cover 74. Thus, safety caps can come in various sizes and shapes while providing increased protection against the choking hazard. Of course openings can be provided in any of the designs shown to further protect against the choking hazard.

Figure 10A:
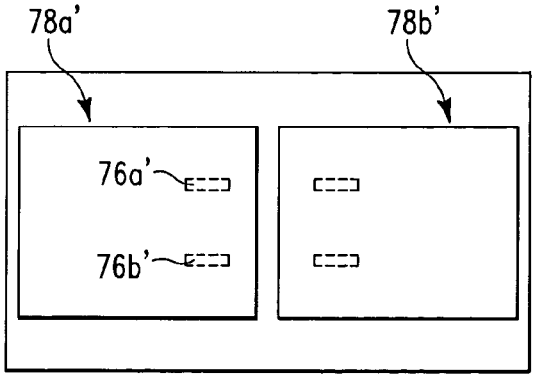
FIGS. 10*a*, 10*b*, 11*a*, 11*b*, 12*a*, 12*b*, 13*a*–13*c*, 14*a*, 14*c* are front views of two prong embodiments of the electrical outlet safety cap of the present invention showing shield portions that have at least one dimension that is sufficiently large to reduce the chance of choking on the safety cap.
Figure 10B:
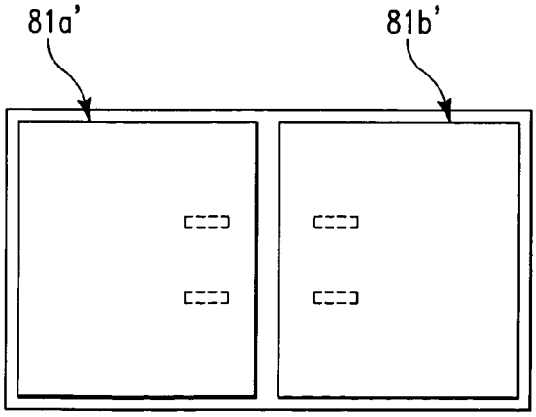
Figure 11A:
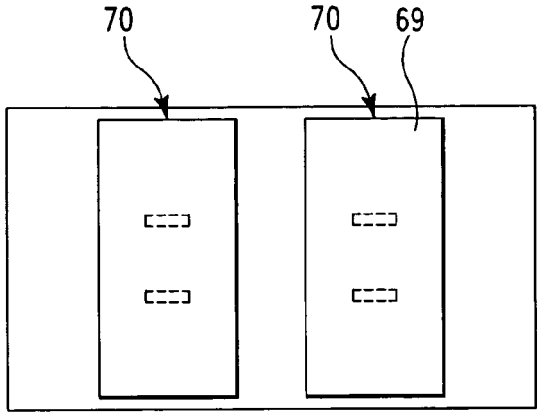
Figure 11B:
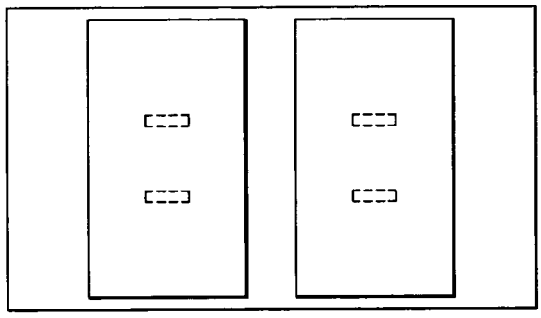
Figure 13A:
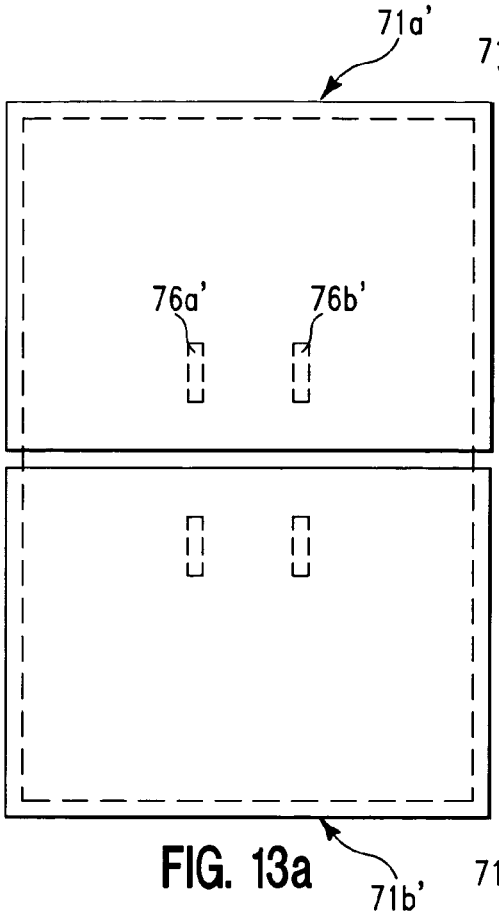
Figure 14A:
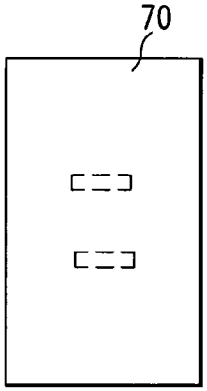
Figure 14B:
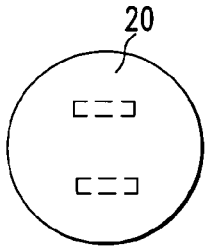
Prior Art FIG. 14b
Figure 14C:
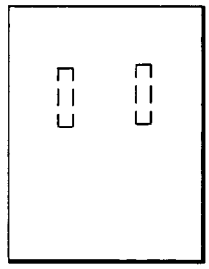
Figure 14D:
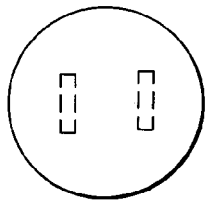
Prior Art FIG. 14d
Figure 15A:
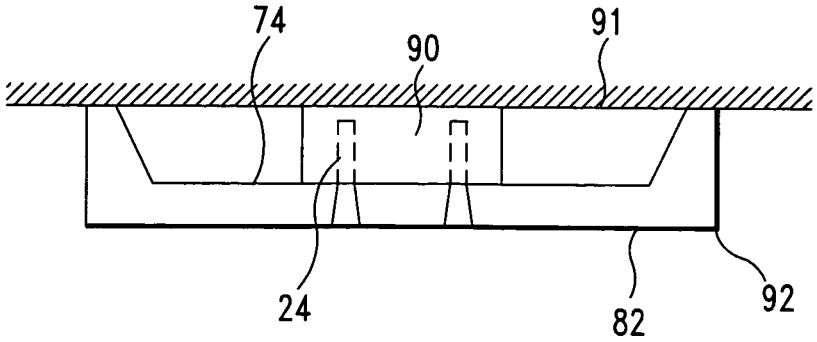
FIGS. 15*a*–15*d* are side views of various embodiments of shields of the present as mounted to wall oulets.
Figure 15B:
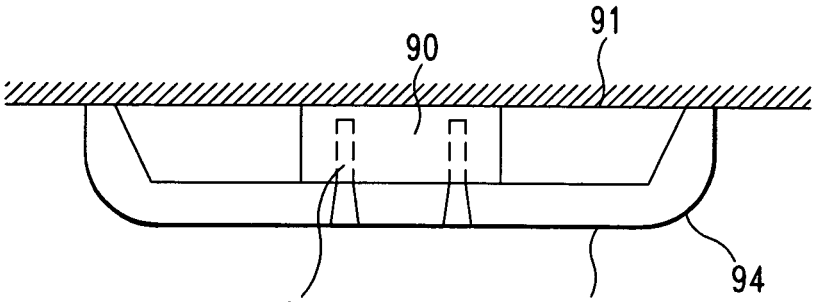
Figure 15C:
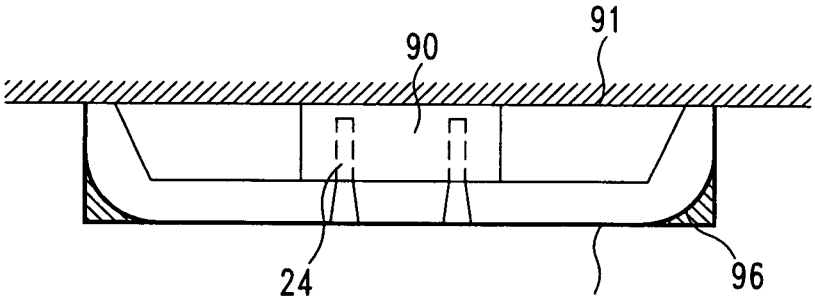
Figure 15D:
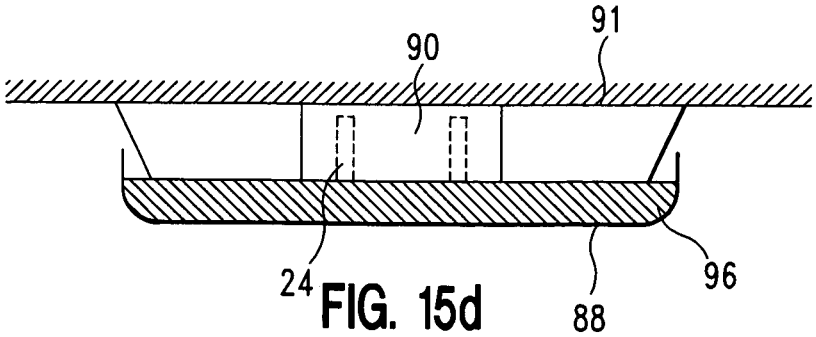

Safety caps 71*a*, 71*b*, 78*a*, 78*b*, 81*a*, 81*b* having shields 72*a*, 72*b*, 80*a*, 80*b*, 82*a*, 82*b* with three prongs 76*a*–76*c* are shown in FIGS. 8*a*–8*b* and 9*a*–9*b*. Safety caps 78*a*', 78*b*', 81*a*', 81*b*' similar to those shown in FIGS. 9*a*–9*b* but with only two prongs 76*a*'–76*b*', are shown in FIGS. 10*a*–10*b*. Similarly, safety caps 71*a*', 71*b*', similar to those shown in FIGS. 8*a*–8*b* but with only two prongs 76*a*'–76*b*', are shown in FIG. 13*a*. Safety cap 70 mounted on cover plate 74 are shown in FIGS. 11*a*–11*b*.

Figure 12A:
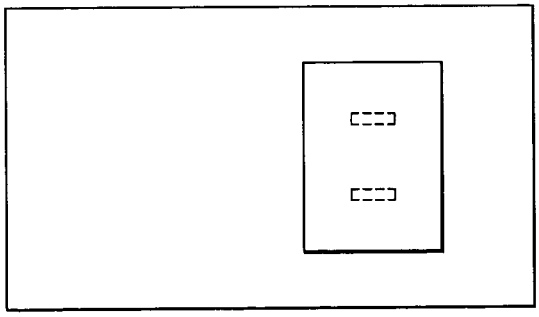
Figure 12B:
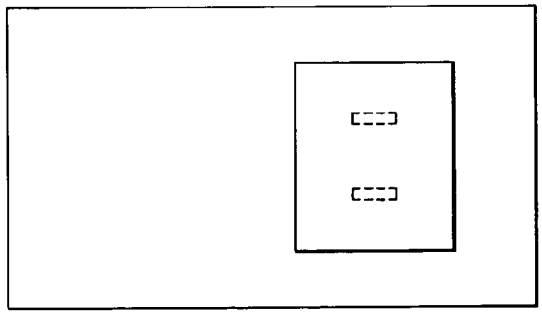

The designs permit one safety cap 70 to be removed while the other cap remains in place, as shown in FIGS. 12*a*–12*b*. Both safety caps can also be removed.

Figure 13B:
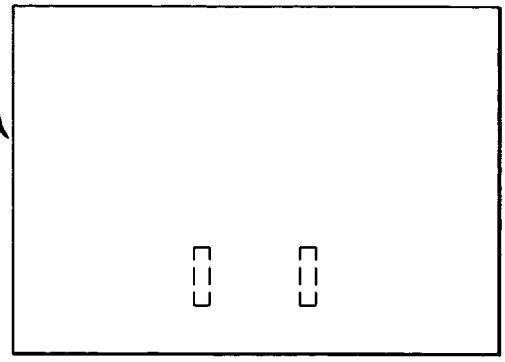
Figure 13D:
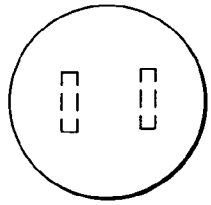
Prior Art FIG. 13d
FIGS. 13*d*, 14*b*, and 14*d* are front views of the safety cap shield of the prior art for comparison with some of the embodiments of the present invention.
Figure 13C:
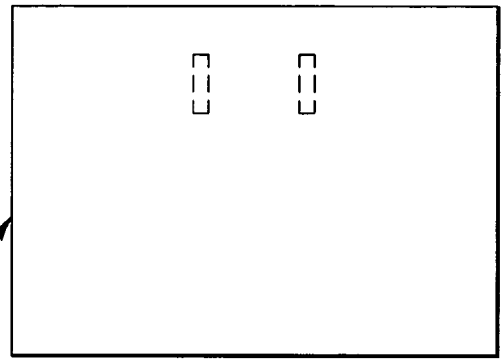

Size comparisons are provided of safety caps 71*a*', 71*b*' of FIGS. 13*b*–13*c* with standard prior art safety cap 20 of FIG. 13*d*. Similarly, size comparison is provided of safety cap 70 of FIG. 14*a* with standard prior art safety cap 20 of FIG. 14*b*. Yet another size comparison is provided in FIGS. 14*c*–14*d*.

Cross sectional views of various shields 82, 84, 86, 88 having prongs 24 plugged in to wall outlet sockets 90, as shown in FIGS. 15*a*–15*d*. Sockets 90 are positioned in standard wall outlet cover plates 74 that are screwed into sockets 90 and mounted against wall 91. Different shields 82, 84, 86, 88 with different amounts of corner rounding and different amounts of corner filling are shown. Such corner rounding and corner filling are alternate ways to increase strength of shields 84, 86, 88. Shield 82 has an angled corner 92, in this case the angle being approximately 90 degrees, and it has no appreciable corner rounding. Shield 84 is similar to shield 82 but it has rounded corners 94. Shield 86 is similar to shield 84 but it has rounded corners 96 that are filled with additional plastic material for greater support. Shield 88 is similar to shield 86 but in addition to corners a greater amount of shield 88 is filled to provide even more support.

While several embodiments of the invention, together with modifications thereof, have been described in detail herein and illustrated in the accompanying drawings, it will be evident that various further modifications are possible without departing from the scope of the invention. For example, various sizes and shapes of shields 28, 40, 46, 66*a*, 66*b*, and various sizes, shapes, and locations of openings 26, 44 in the shields can be used. Nothing in the above specification is intended to limit the invention more narrowly than the appended claims. The examples given are intended only to be illustrative rather than exclusive.

What is claimed is:

1. A safety cap for an electric outlet having a plurality of electrical contact holes, comprising a shield extending to completely cover the electrical contact holes when the safety cap is positioned on the electric outlet, said shield including at least one opening positioned for reducing a choking hazard if the cap is inserted in the mouth of a small child, wherein said opening is located outside of the electrical contact holes and space between the electrical contact holes when the cap is positioned in any possible orientation on the electrical outlet, wherein said shield has a central portion thickness adjacent said contact holes, wherein said shield has an opening region thickness adjacent said opening, wherein said opening region thickness is not substantially less than said central portion thickness.

2. A safety cap as recited in claim 1, wherein area of said at least one opening is sized to provide sufficient ventilation for breathing.

3. A safety cap as recited in claim 1, comprising two of said openings.

4. A safety cap as recited in claim 1, wherein said opening has a diameter of at least 0.2 inches.

5. A safety cap as recited in claim 1, wherein said opening has a diameter in the range from about 0.2 inches to about 0.3 inches.

6. A safety cap as recited in claim 1, wherein said opening is positioned in the shield spaced from each of the electrical contact holes when the cap is covering the electrical contact hole.

7. A safety cap as recited in claim 1, wherein said opening is spaced from each of the electrical contact holes by at least a 1/16 of an inch.

8. A safety cap as recited in claim 1, wherein said opening is spaced from each of the electrical contact holes by at least an 1/8 of an inch.

9. A safety cap as recited in claim 1, wherein said shield includes an outside edge, wherein said opening is spaced from said outside edge.

10. A safety cap as recited in claim 9, wherein said opening is spaced from said outside edge by at least 0.2 inches.

11. A safety cap as recited in claim 1, wherein said opening comprises a round shaped opening.

12. A safety cap as recited in claim 1, wherein said opening comprises a slot, a rectangle, or a triangle shaped opening.

13. A safety cap as recited in claim 1, wherein said shield is fabricated of a plastic material.

14. A safety cap as recited in claim 1, further comprising a prong connected to said shield, said prong for inserting into one of the electrical contact holes, wherein said opening is spaced from said prong.

15. A safety cap as recited in claim 14, wherein said opening is spaced from said prong by at least a 1/16 of an inch.

16. A safety cap as recited in claim 14, wherein said opening is spaced from said prong by at least an 1/8 of an inch.

17. A method of fabricating a safety cap for an electric outlet having a plurality of electrical contact holes, comprising:

a. providing a safety cap having a shield extending to completely cover the electrical contact holes when said safety cap is positioned on the electric outlet; and b. providing at least one opening in said shield, wherein said opening is for allowing sufficient air to flow there through to reduce a choking hazard for a small child, wherein said opening is located outside space of the electrical contact holes and between the electrical contact holes when the cap is positioned in any possible orientation on the electric outlet, wherein said shield has a central portion thickness adjacent said electrical contact holes, wherein said shield has an opening region thickness adjacent said opening, wherein said opening region thickness is not substantially less than said central portion thickness.

18. A method as recited in claim 17, wherein said opening is sized to allow insertion of a tool to aid in removal of said safety cap from a bodily orifice.

19. A method as recited in claim 17, wherein said opening has a dimension of at least 0.2 inches.

20. A method as recited in claim 17, wherein said opening has a dimension in the range from about 0.2 inches to about 0.3 inches.

21. A method as recited in claim 17, wherein said shield has a dimension equal to or greater than 1½ inches.

22. A method as recited in claim 21, wherein said shield has a dimension greater than 1⅔ inches.

23. A method as recited in claim 21, wherein said shield has a dimension greater than 1¾ inches.

24. A safety cap for an electric outlet having a plurality of electrical contact holes, comprising a shield extending to completely cover the electrical contact holes when the safety cap is positioned on the electric outlet in any possible orientation, wherein said shield has a dimension larger than 1½ inches, wherein said shield has a central portion thickness adjacent said electrical contact holes, wherein said shield has a furthest portion that is furthest from said electrical contact holes when said safety cap is positioned on the electric outlet, wherein said furthest portion has a furthest portion thickness, wherein said furthest portion thickness is not substantially less than said central portion thickness.

25. A safety cap as recited in claim 24, wherein said dimension is at least equal to 1⅔ inches.

26. A safety cap as recited in claim 24, wherein said dimension is at least equal to 1¾ inches.

27. A safety cap as recited in claim 24, further wherein said shield has two dimensions that are larger than 1½ inches.

28. A safety cap as recited in claim 24, wherein a pair of said shields mounted on an electrical outlet plug substantially covers a standard two-socket outlet plug cover.

29. A safety cap as recited in claim 24, wherein said shield further comprises at least one opening to allow sufficient air to flow there through to reduce a choking hazard for a small child.

30. A safety cap as recited in claim 29, wherein area of said at least one opening is sized to provide sufficient ventilation for breathing.

31. A safety cap as recited in claim 29, further comprising two of said openings.

32. A safety cap as recited in claim 29, wherein said opening has a diameter of at least 0.2 inches.

33. A safety cap as recited in claim 29, wherein said opening has a diameter in the range from about 0.2 inches to about 0.3 inches.

34. A safety cap as recited in claim 29, wherein said opening is positioned in the shield spaced from the electrical contact hole when the cap is covering the electrical contact hole.

35. A safety cap as recited in claim 34, wherein said opening is spaced from the electrical contact hole by at least 1/16 of an inch.

36. A safety cap as recited in claim 34, wherein said opening is spaced from the electrical contact hole by at least ⅛ of an inch.

37. A safety cap as recited in claim 29, wherein said shield includes an outside edge, wherein said opening is spaced from said outside edge.

38. A safety cap as recited in claim 37, wherein said opening is spaced from said outside edge by at least 0.2 inches.

39. A safety cap as recited in claim 29, wherein said opening comprises a round-shaped opening.

40. A safety cap as recited in claim 29, wherein said opening comprises at least one from the group including a slot-shaped, a rectangle-shaped, and a triangle-shaped opening.

41. A safety cap as recited in claim 29, further comprising a prong connected to said shield, said prong for inserting into the electrical contact hole, wherein said opening is spaced from said prong.

42. A safety cap as recited in claim 41, wherein said opening is spaced from said prong by at least a 1/16 of an inch.

43. A safety cap as recited in claim 42, wherein said opening is spaced from said prong by at least an ⅛ of an inch.

44. A safety cap as recited in claim 24, wherein said shield is fabricated of a plastic material.

45. A safety cap as recited in claim 24, wherein said shield includes corners filled with material.

46. A safety cap as recited in claim 24, wherein said shield includes rounded corners.

47. A safety cap as recited in claim 24, wherein said shield includes an angled corner.

48. A safety cap as recited in claim 1, wherein two of the electrical contact holes define a line that extends through said two electrical contact holes, wherein said opening is located along said line.

49. A safety cap as recited in claim 48, further comprising a second opening located along said line.

50. A safety cap as recited in claim 49, wherein said opening is located on a first side of said space and said second opening is located on a second side of said space opposite said first side.

51. A method as recited in claim 17, wherein two of the electrical contact holes define a line, wherein said opening is located along said line.

52. A method as recited in claim 51, further comprising a second opening located along said line.

53. A method as recited in claim 52, wherein said opening is located on a first side of said space and said second opening is located on a second side of said space opposite said first side.

54. A safety cap as recited in claim 29, wherein the electric outlet has at least two electrical contact holes, wherein said opening is located outside space between the electrical contact holes when the cap is positioned on the electric outlet.

55. A safety cap as recited in claim 54, wherein two of the electrical contact holes define a line, wherein said opening is located along said line.

56. A safety cap as recited in claim 55, further comprising a second opening located along said line.

57. A safety cap as recited in claim 56, wherein said opening is located on a first side of said space and said second opening is located on a second side of said space opposite said first side.

58. A safety cap for an electric outlet having a plurality of electrical contact holes, comprising a shield extending to completely cover the electrical contact holes when the safety cap is positioned on the electric outlet, said shield including at least two openings positioned for reducing a choking hazard if the cap is inserted in the mouth of a small child, wherein said openings are located outside of the electrical contact holes and space between the electrical contact holes when the cap is positioned in any possible orientation on the electrical outlet, wherein two of the electrical contact holes define a first line that extends through said two electrical contact holes, wherein said openings define a second line that extends through said openings, wherein said second line is parallel to said first line.

59. A safety cap as recited in claim 58, wherein said openings have a diameter of at least 0.2 inches.

60. A safety cap as recited in claim 58, wherein said openings are spaced from each of the electrical contact holes by at least a 1/16 of an inch.

61. A safety cap as recited in claim 58, wherein said shield includes an outside edge, wherein said openings are spaced from said outside edge by at least 0.2 inches.

62. A safety cap as recited in claim 58, further comprising a prong connected to said shield, said prong for inserting into one of the electrical contact holes, wherein said openings are spaced from said prong.

63. A method as recited in claim 58, wherein said shield has a dimension greater than 1⅔ inches.

64. A method as recited in claim 63, wherein said shield has a dimension greater than 1¾ inches.

* * * * *